US006200718B1

(12) United States Patent
Takasaki et al.

(10) Patent No.: US 6,200,718 B1
(45) Date of Patent: Mar. 13, 2001

(54) POLYMER TONER AND METHOD OF PRODUCTION THEREOF

(75) Inventors: Takahiro Takasaki; Noboru Yanagida, both of Kawasaki (JP)

(73) Assignee: Nippon Zeon Co., Ltd., Tokyo (JP)

( * ) Notice: Subject to any disclaimer, the term of this patent is extended or adjusted under 35 U.S.C. 154(b) by 0 days.

(21) Appl. No.: 09/319,380

(22) PCT Filed: Dec. 5, 1997

(86) PCT No.: PCT/JP97/04475

§ 371 Date: Jun. 4, 1999

§ 102(e) Date: Jun. 4, 1999

(87) PCT Pub. No.: WO98/25185

PCT Pub. Date: Nov. 6, 1998

(30) Foreign Application Priority Data

Dec. 5, 1996 (JP) ..... 8-340676

(51) Int. Cl.[7] ..... G03G 9/093
(52) U.S. Cl. ..... 430/109; 430/138; 399/297
(58) Field of Search ..... 430/106, 109, 430/138; 399/297

(56) References Cited

U.S. PATENT DOCUMENTS

| | | | | |
|---|---|---|---|---|
| 4,601,968 | | 7/1986 | Hyosu | 430/137 |
| 5,294,233 | * | 3/1994 | Kitahara et al. | 44/334 |
| 5,385,803 | | 1/1995 | Duff et al. . | |
| 5,466,556 | * | 11/1995 | Inaishi | 430/138 |

FOREIGN PATENT DOCUMENTS

| | | |
|---|---|---|
| 0 447 045 | 9/1991 | (EP) . |
| 57-45558 | 3/1982 | (JP) . |
| 58-162604 | 9/1983 | (JP) . |
| 59-62870 | 4/1984 | (JP) . |
| 60-137913 | 7/1985 | (JP) . |
| 60-173552 | 9/1985 | (JP) . |
| 61-118758 | 6/1986 | (JP) . |
| 63-269164 | 11/1988 | (JP) . |
| 2-259657 | 10/1990 | (JP) . |
| 3-89932 | 4/1991 | (JP) . |
| 3-136065 | 6/1991 | (JP) . |
| 3-203746 | 9/1991 | (JP) . |
| 4-58023 | 9/1992 | (JP) . |
| 6-12460 | 2/1994 | (JP) . |
| 7-128908 | 5/1995 | (JP) . |

OTHER PUBLICATIONS

Abstract for JP 60–147746, Database WPI, Derwent Publications Ltd., Aug. 3, 1985.

* cited by examiner

*Primary Examiner*—John Goodrow
(74) *Attorney, Agent, or Firm*—Armstrong, Westerman, Hattori, McLeland & Naughton, LLP

(57) ABSTRACT

A polymerized toner of core-shell structure, comprising core particles composed of colored polymer particles which contain a compound having at least one >C=N$^+$< structure in its molecule and a colorant, and a layer of a polymer having a glass transition temperature higher than that of a polymer component making up the core particles, said polymer layer covering each of the core particles, a production process thereof, an image forming process comprising using the polymerized toner, and an image forming apparatus containing the polymerized toner.

31 Claims, 1 Drawing Sheet

POLYMER TONER AND METHOD OF PRODUCTION THEREOF

TECHNICAL FIELD

The present invention relates to a polymerized toner, and more particularly to a polymerized toner suitable for use in developing an electrostatic image formed by an electrophotographic process, electrostatic recording process or the like, a production process thereof, an image forming process comprising using such a polymerized toner, and an image forming apparatus containing the polymerized toner.

BACKGROUND ART

In the electrophotographic process or electrostatic recording process, there are two-component developers composed of a toner and carrier particles, and one-component developers composed substantially of a toner alone and making no use of any carrier particles as developers for making electrostatic images (electrostatic latent images) visible. The one-component developers include magnetic one-component developers containing magnetic powder, and non-magnetic one-component developers containing no magnetic powder. In the non-magnetic one-component developers, a flowability improver such as colloidal silica is often added independently in order to enhance the flowability of the toner. As the toner, there are generally used colored particles obtained by dispersing a colorant such as carbon black and other additives in a binder resin and granulating the dispersion.

Processes for producing a toner are roughly divided into a grinding process and a polymerization process. In the grinding process, a synthetic resin, a colorant and optional other additives are melted and mixed, the mixture is ground, and the ground product is then classified so as to obtain particles having a desired particle diameter, thereby obtaining a toner. In the polymerization process, a polymerizable monomer composition is prepared by uniformly dissolving or dispersing a colorant, a polymerization initiator and optional various additives such as a crosslinking agent and a charge control agent in a polymerizable monomer, the polymerizable monomer composition is dispersed in an aqueous dispersion medium containing a dispersion stabilizer by means of a stirrer to form minute droplets of the polymerizable monomer composition, and the dispersion containing the minute droplets is then heated to subject the droplets to suspension polymerization, thereby obtaining colored polymer particles (polymerized toner) having a desired particle diameter.

In either developer, an electrostatic latent image is actually developed with the toner. In an image forming apparatus such as an electrophotographic apparatus or electrostatic recording apparatus, an electrostatic latent image is generally formed on a photosensitive member evenly charged by exposure to a light pattern, and a toner is applied to the electrostatic latent image to form a toner image (visible image). The toner image is transferred to a transfer medium such as transfer paper, and the unfixed toner image is then fixed to the transfer medium by a method such as heating, pressing or use of solvent vapor. In the fixing step, the toner is often fusion-bonded to the transfer medium by passing the transfer medium, to which the toner image has been transferred, through between a heating roll (fixing roll) and a press roll to press-bond the toner to the transfer medium under heat.

Images formed by an image forming apparatus such as an electrophotographic copying machine are required to improve their definition year by year. As a toner used in the image forming apparatus, a toner obtained by the grinding process has heretofore been mainly used. The grinding process tends to form colored particles having a wide particle diameter distribution. In order for the toner to exhibit satisfactory developing characteristics, therefore, the ground product must be classified to adjust the particles so as to have a particle diameter distribution limited to a certain extent. However, the classification itself is complicated, and its yield is poor, and so the percent yield of the toner is reduced to a great extent. Therefore, the polymerized toner easy to control its particle diameter without conducting complicated production steps such as classification has come to attract attention in recent years. According to the suspension polymerization process, a polymerized toner having desired particle diameter and particle diameter distribution can be obtained without need of grinding and classification. However, the conventional polymerized toners have involved a problem that they cannot fully meet requirements in recent years, such as the speeding-up of copying, the formation of full-color images and energy saving.

In recent years, copying machines, printers and the like of the electrophotographic system have been required not only to reduce demand power, but also to achieve the speeding-up of copying or printing. A step in which energy is particularly demanded in the electrophotographic system is a fixing step conducted after transferring a toner from a photosensitive member to a transfer medium such as transfer paper. In the fixing step, the toner is fixed to the transfer medium by heating and melting it. Therefore, a heating roll heated to a temperature of at least 150° C. is used, and electric power is used as an energy source therefor. There is a demand for lowering the temperature of the heating roll from the viewpoint of energy saving. In order to lower the temperature of the heating roll, it is necessary to use a toner capable of fixing at a temperature lower than that heretofore used. Namely, it is necessary to lower the fixing temperature of the toner itself. The use of the toner capable of fixing at a temperature lower than that heretofore used permits lowering the temperature of the heating roll, and on the other hand shortening the fixing time when the temperature of the heating roll is not very lowered. Therefore, such a toner can meet the speeding-up of copying and printing.

In order to meet the requirements, such as energy saving and the speeding-up of copying, from the image forming apparatus in the design of a toner, it is only necessary to lower the glass transition temperature of a binder resin making up the toner. When a toner is made up of a binder resin having a low glass transition temperature, however, the toner becomes poor in the so-called shelf stability because particles themselves of the toner tend to undergo blocking during storage or shipment, or in a toner box of an image forming apparatus, to aggregate.

In recent years, there has been a demand for formation of bright images in color copying or color printing by the electrophotographic system. For example, in the full-color copying, the mere melting and softening of toners in a fixing step to fusion-bond the toners to a transfer medium are not enough, but it is necessary to uniformly melt and mix the toners of different colors to mix their colors. In particular, since color images have come to be often used in OHP (overhead projector) sheets for presentations in various meetings or conferences, toner images fixed to such OHP sheets have been required to have excellent permeability through OHP. In order to meet the excellent permeability through OHP, it is necessary for the toners to uniformly melt on a transparent OHP sheet made of a synthetic resin.

Therefore, the melt viscosity of each toner at about the fixing temperature thereof must be designed low compared with the conventional toners. Means for lowering the melt viscosity of the toner include a method in which the molecular weight or glass transition temperature of a binder resin used is lowered compared with the binder resins for the conventional toners. In either method, however, the toner becomes poor in shelf stability because the toner tends to undergo blocking.

As a method for obtaining a polymerized toner having excellent fixing ability, it has heretofore been proposed in, for example, Japanese Patent Application Laid-Open No. 136065/1991 to subject a polymerizable monomer containing a colorant and a charge control agent to suspension polymerization in the presence of a macromonomer. The macromonomer is a relatively long-chain linear molecule having a polymerizable functional group, for example, a group containing an unsaturated bond such as a carbon-carbon double bond, at its molecular chain terminal. According to this method, the macromonomer is incorporated as a monomer unit into the molecular chain of a polymer formed. Therefore, many branches attributable to the long-chain linear molecule of the macromonomer are generated in the molecular chain of the polymer. The polymer formed apparently becomes a high molecular weight polymer due to entanglement of the branches, i.e., the so-called physical crosslinking, so that the offset resistance of the toner is improved. On the other hand, the physical crosslinking by the macromonomer component is different from chemical crosslinking using a crosslinking monomer such as divinylbenzene and is of a loose crosslinked structure, and so the crosslinked structure is easy to be broken by heating. Accordingly, this polymerized toner is easily melted upon fixing using a heating roll and hence has excellent fixing ability. However, the polymerized toner tends to undergo aggregation among toner particles during storage, and is hence unsatisfactory from the viewpoint of shelf stability.

According to the conventional methods for lowering the fixing temperature of a toner and improving the uniformly melting ability thereof, as described above, an adverse correlation that the fixing ability of the resulting toner is improved, but its shelf stability is lowered arises. As a means for solving this adverse correlation, there has been proposed the so-called capsule type toner in which a toner made up of a binder resin having a low glass transition temperature is covered with a polymer having a high glass transition temperature, thereby improving the blocking resistance of the toner to solve the problem of shelf stability.

As a production process of the capsule type toner, for example, Japanese Patent Application Laid-Open No. 173552/1985 has proposed a process in which a coating layer composed of a colorant, magnetic particles or a conductive agent and a binder resin is formed on each surface of spherical core particles having a minute particle size by means of a jet mill. As the core particles, there are used particles formed of a thermoplastic transparent resin such as an acrylate resin or styrene resin. In this publication, it has been reported that according to this process, a toner of multi-layer structure, which has excellent flowability and improved functional characteristics, can be obtained. When core particles having a low glass transition temperature are used in this method, however, the core particles themselves tend to undergo aggregation. In addition, according to this process, the coating thickness of the binder resin is liable to thicken. Accordingly, this process is difficult to provide a toner improved in both fixing ability and uniformly melting ability while retaining its good shelf stability.

Japanese Patent Application Laid-Open No. 259657/1990 has proposed a process for producing a toner for electrophotography, in which crosslinked toner particles prepared by suspension polymerization are added to a solution with an encapsulating polymer, a charge control agent and a parting agent dissolved in an organic solvent, and a poor solvent is then added to the resultant mixture to form a coating film of the encapsulating polymer containing the charge control agent and parting agent on each surface of the crosslinked toner particles. According to this process, however, it is difficult to obtain spherical particles because the solubility of the encapsulating polymer is reduced by the addition of the poor solvent to deposit the polymer on each surface of the crosslinked toner particles. The capsule wall formed on the surface of each crosslinked toner particle according to this process is uneven in thickness, and moreover is relatively thick. As a result, the effects of improving development properties and fixing ability are insufficient.

Japanese Patent Application Laid-Open No. 45558/1982 has proposed a process for producing a toner for developing electrostatic latent images, in which core particles formed by polymerization are mixed with and dispersed in a 1 to 40 wt. % aqueous latex solution, and a water-soluble inorganic salt is then added to the dispersion to form a coating layer formed of fine particles obtained by emulsion polymerization on each surface of the core particles. However, this process has involved a drawback that the temperature and humidity dependence of charge properties of the resultant toner becomes high due to the influence of a surfactant and the inorganic salt remaining on the fine particles, and the charge properties are deteriorated under high-temperature and high-humidity conditions in particular.

Japanese Patent Application Laid-Open No. 118758/1986 discloses a process for producing a toner, in which a composition containing a vinyl monomer, a polymerization initiator and a colorant is subjected to suspension polymerization to obtain core particles, and another vinyl monomer capable of providing a polymer having hydrophilicity at least equal to that of the resin contained in the core particles and a glass transition temperature higher than that of said resin is polymerized in the presence of the core particles to form shell on each of the core particles. According to this process, however, the vinyl monomer for forming the shell is caused to be adsorbed on each of the core particles to grow it, so that in many cases, it may be difficult to create a clear core-shell structure because the vinyl monomer absorbed in the interior of the core particles is polymerized. Accordingly, this process is difficult to provide a toner sufficiently improved in shelf stability. In addition, in order to create a clear core-shell structure so as to improve the shelf stability, it has been necessary to thicken the thickness of the shell.

Japanese Patent Application Laid-Open No. 128908/1995 discloses a process for directly producing a polymerized toner by subjecting a monomer composition containing a polymerizable monomer, a colorant and a parting agent to suspension polymerization in an aqueous dispersion medium, the process comprising the steps of causing the parting agent to contain in a proportion of 10 to 40 parts by weight per 100 parts by weight of the polymerizable monomer and removing the parting agent on the surface of the toner formed after completion of the polymerization step. According to this process, the parting agent on the surface of the toner is removed, so that staining due to attachment of the parting agent (wax) to a developing drum, a photosensitive drum, a transfer drum and/or the like can be reduced. However, this process cannot fully improve the shelf stability, fixing temperature and the like of the toner, and the resulting toner tends to cause fogging, lowering of image density, etc.

DISCLOSURE OF THE INVENTION

It is an object of the present invention to provide a polymerized toner which has a low fixing temperature and uniformly melting ability, and is excellent in shelf stability (blocking resistance), low in the dependence of charge level on environment, and hard to cause fogging, lowering of image density, etc., and a production process thereof.

Another object of the present invention is to provide a polymerized toner which can meet the speeding-up of copying or printing, the formation of full-color images, and energy saving, and a production process thereof.

A further object of the present invention is to provide a polymerized toner capable of forming a toner image which exhibits excellent permeability (permeability through OHP) when conducting printing on an OHP sheet with the toner and fixing the resulting image thereto, and a production process thereof.

A still further object of the present invention is to provide an image forming process comprising using the polymerized toner having such excellent various properties, and an image forming apparatus in which said polymerized toner is contained.

The present inventors have carried out an extensive investigation with a view toward overcoming the above-described problems involved in the prior art. As a result, it has been found that when a compound having at least one $>C{=}N^{+}<$ structure in its molecule is caused to be contained in core particles composed of colored polymer particles, and a polymerizable monomer for shell, which is capable of forming a polymer having a glass transition temperature higher than that of the polymer component making up the core particles, is polymerized in the presence of the core particles to form a polymer layer serving as shell on each surface of the core particles, thereby producing a capsule type polymerized toner (polymerized toner of core-shell structure), the polymerized toner can be provided as a toner which has a low fixing temperature and uniformly melting ability, and is excellent in shelf stability (blocking resistance). This polymerized toner is low in the dependence of charge level on environment, and hard to cause fogging, deterioration of image density, etc., and exhibits excellent permeability through OHP. The present invention has been led to completion on the basis of these findings.

According to the present invention, there is thus provided a polymerized toner of core-shell structure, comprising core particles composed of colored polymer particles which contain a compound having at least one $>C{=}N^{+}<$ structure in its molecule and a colorant, and a layer of a polymer having a glass transition temperature higher than that of a polymer component making up the core particles, said polymer layer covering each of the core particles.

According to the present invention, there is also provided a process for producing a polymerized toner of core-shell structure, which comprises the steps of (I) polymerizing a polymerizable monomer composition containing a compound having at least one $>C{=}N^{+}<$ structure in its molecule, a colorant and a polymerizable monomer for core to prepare core particles formed of colored polymer particles; and then (II) polymerizing a polymerizable monomer for shell, which is capable of forming a polymer having a glass transition temperature higher than that of a polymer component making up the core particles, in the presence of the core particles in an aqueous dispersion medium to form shell which is formed of a polymer layer and covers each of the core particles.

According to the present invention, there is further provided an image forming process, comprising the steps of applying a toner to the surface of a photosensitive member, on which an electrostatic latent image has been formed, to make the latent image visible, and then transferring the visible image to a transfer medium, wherein the above-described polymerized toner of core-shell structure is used as the toner.

According to the present invention, there is still further provided an image forming apparatus, comprising a photosensitive member, a means for charging the surface of the photosensitive member, a means for forming an electrostatic latent image on the surface of the photosensitive member, a means for receiving a toner, a means for supplying the toner to develop the electrostatic latent image on the surface of the photosensitive member, thereby forming a toner image, and a means for transferring the toner image from the surface of the photosensitive member to a transfer medium, wherein the means for receiving the toner contains the above-described polymerized toner of core-shell structure.

Figure 1:
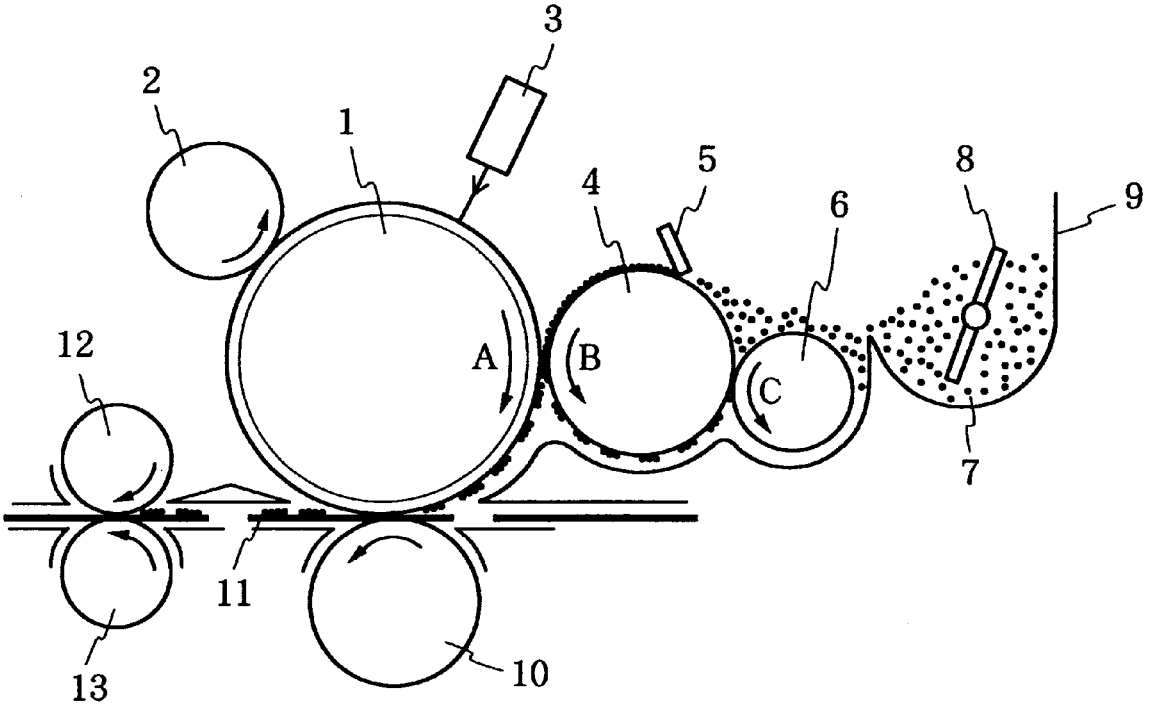
FIG. 1 is a cross-sectional view illustrating an example of an image forming apparatus to which a polymerized toner according to the present invention is applied.

BEST MODE FOR CARRYING OUT THE INVENTION (Compound having at least one $>C{=}N^{+}<$ structure in its molecule).

In the present invention, a compound having, in its molecule, at least one structure represented by the formula (1):

$$>C{=}N^{\oplus}< \qquad (1)$$

is caused to be contained in core particles.

A typical example of this compound includes a heterocycle-containing compound having the bond represented by the formula (1) on the end of its molecular chain or within its molecular chain (in its principal chain or side chain).

As examples of such a heterocycle-containing compound, may be mentioned compound represented by the following formulae (2) to (11). In these formulae, $R^1$ means a principal chain of each compound, $R^2$ denotes a principal chain of the compound, a hydrogen atom or a hydrocarbon group having at most 6 carbon atoms, and $R^3$, $R^4$ and $R^5$ are independently a hydrocarbon group. In the hydrocarbon group, at least part of hydrogen atoms in its molecule may be substituted by a substituent such as a halogen atom, or a nitro, epoxy, carboxyl or hydroxyether group. $X^{-}$ means an anion.

Formula (2):

(2)

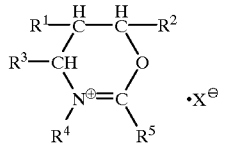

Formula (3):

(3)

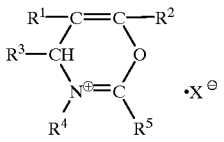

The compounds represented by the formulae (2) and (3) are compounds having a 1,3-oxazine structure typified by a 1,3-oxazine ring, 4H,5H-1,3-oxazine ring or the like, in which the nitrogen atom in the heterocyclic ring has been converted into a quaternary ammonium salt.

Formula (4):

(4)

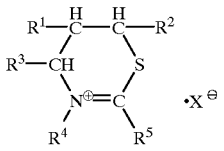

Formula (5):

(5)

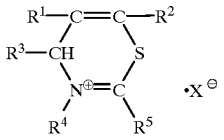

The compounds represented by the formulae (4) and (5) are compounds having a 1,3-thiazine ring or 5H,6H-1,3-thiazine ring, in which the nitrogen atom in the thiazine ring has been converted into a quaternary ammonium salt.

Formula (6):

(6)

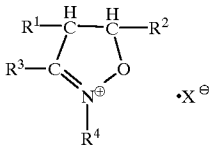

Formula (7):

(7)

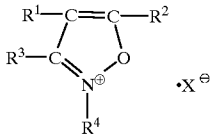

The compounds represented by the formulae (6) and (7) are compounds having an isoxazole ring or 4H,5H-isoxazole ring, in which the nitrogen atom in the isoxazole ring has been converted into a quaternary ammonium salt.

Formula (8):

(8)

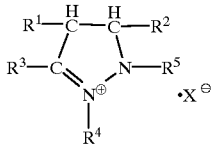

Formula (9):

(9)

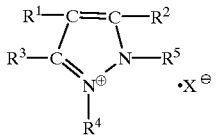

The compounds represented by the formulae (8) and (9) are compounds having a 1,2-diazole ring or 4H,5H-1,2-diazole ring, in which the nitrogen atom in the diazole ring has been converted into a quaternary ammonium salt.

Formula (10):

(10)

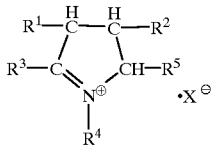

Formula (11):

(11)

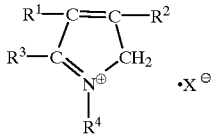

The compounds represented by the formulae (10) and (11) are compounds having a 2H-pyrrole ring or 2H,3H,4H-pyrrole ring, in which the nitrogen atom in the pyrrole ring has been converted into a quaternary ammonium salt.

Other typical examples of the compound having at least one structure represented by the formula (1) in its molecule include, as polymers, modified polymers obtained by reacting an organic compound, which will be described subsequently, with ① a living anionic polymer obtained by polymerizing a monomer polymerizable by a catalyst based on a metal such as an alkali metal or alkaline earth metal (so-called anionic polymerization catalyst), and having an ion of such a metal at its terminal, or ② an unsaturated polymer having double bonds in its polymer chain or side chain in the presence of an alkali metal, alkaline earth metal, transition metal or halide thereof (Lewis acid), and then hydrolyzing the reaction product; and hydrogenated modified polymers obtained by hydrogenating double bonds in the modified polymers thus obtained (Japanese Patent Application Laid-Open Nos. 162604/1983, 137913/1985 and 89932/1991).

As examples of the organic compound reacted with ① the living polymer or ② the metal-added unsaturated polymer, may be mentioned N-substituted lactams such as N-methyl-β-propiolactam, N-t-butyl-β-propiolactam, N-phenyl-β-propiolactam, N-methoxyphenyl-β-propiolactam, N-naphthyl-β-propiolactam, N-methyl-2-pyrrolidone, N-t-butyl-2-pyrrolidone, N-phenyl-2-pyrrolidone, N-methoxyphenyl- 2-pyrrolidone, N-vinyl-2-pyrrolidone, N-benzyl-2-pyrrolidone, N-naphthyl-2-pyrrolidone, N-methyl-5-methyl-2-pyrrolidone, N-t-butyl-5-methyl-2-pyrrolidone, N-phenyl-5-methyl-2-pyrrolidone, N-methyl-3,3'-dimethyl-2-pyrrolidone, N-phenyl-3,3'-dimethyl-2-pyrrolidone, N-t-butyl-3,3'-dimethyl-2-pyrrolidone, N-methyl-2-piperidone, N-t-butyl-2-piperidone, N-phenyl-2-piperidone, N-methoxyphenyl-2-piperidone, N-vinyl-2-piperidone, N-benzyl-2-piperidone, N-naphthyl-2-piperidone, N-methyl-5-methyl-2-piperidone, N-t-butyl-5-methyl-2-piperidone, N-phenyl-5-methyl-2-piperidone, N-methyl-3,3'-dimethyl-2-piperidone, N-phenyl-3,3'-dimethyl-2-piperidone, N-t-butyl-3,3'-dimethyl-2-piperidone, N-methyl-ε-caprolactam, N-phenyl-ε-caprolactam, N-methoxylphenyl-ε-caprolactam, N-vinyl-ε-caprolactam, N-benzyl-ε-caprolactam, N-naphthyl-ε-caprolactam, N-methyl-ω-laurylolactam, N-phenyl-ω-laurylolactam, N-t-butyl-ω-laurylolactam, N-vinyl-ω-laurylolactam and N-benzyl-ω-laurylolactam, and their corresponding thiolactams; and N-substituted ethylene ureas such as 1,3-divinylethylene urea, 1,3-diphenylethylene urea, 1,3-di-t-butylethylene urea and 1,3-dimethylethylene urea, and their corresponding N-substituted thioethylene ureas. These organic compounds are compounds having a bond represented by the formula (12):

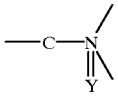

(12)

wherein Y is an oxygen atom or sulfur atom, in their molecules.

Besides the direct reaction of the compound having the bond represented by the formula (12) and capable of imparting the bond represented by the formula (1) when bonded to the resin, an amine and an acid halide may also be allowed to react using an alkali metal, alkaline earth metal or transition metal, or a salt thereof as a catalyst. When the acid halide is a carboxylic acid halide, a compound represented by the formula (2) or (3) is provided. When it is a thiocarboxylic acid on the other hand, a compound represented by the formula (4) or (5) is provided.

Specific examples of the amine include benzylidenealkylamine such as benzylideneethylamine, benzylidenepropylamine, benzylidenebutylamine, benzylidenehexylamine, benzylideneoctylamine and benzylidenestearylamine; and alkylidenealkylamines such as ethylidenepropylamine, ethylideneisobutylamine, propylideneethylamine and propylidenenonylamine. Specific examples of the acid halide include saturated fatty acid halides such as acetyl chloride, valeryl bromide, capryl chloride and lauryl chloride; unsaturated fatty acid such as chloride crotonate and bromide oleate; aromatic carboxylic acid halides such as benzoyl chloride and benzoyl bromide; and saturated thiocarboxylic acid halides such as thioacetyl bromide and thiopropionyl chloride.

Examples of other organic compounds than the above-mentioned compounds include N-substituted aminoketones such as 4-dimethylaminobenzophenone, 4-diethylaminobenzophenone, 4-di-t-butylaminobenzophenone, 4-diphenyl-aminobenzophenone, 4,4'-bis-(dimethylamino)benzophenone, 4,4'-bis(diethylamino)benzophenone, 4,4'-bis(d-t-butylamino)-benzophenone, 4,4'-bis(diphenylamino)benzophenone, 4,4'-bis(divinylamino)benzophenone, 4-dimethylaminoacetophenone, 4-diethylaminoacetophenone, 1,3-bis(diphenylamino)-2-propanone and 1,7-bis(methylethylamino)-4-heptanone, and their corresponding N-substituted aminothioketones; and N-substituted aminoaldehydes such as 4-dimethylaminobenzaldehyde, 4-diphenylaminobenzaldehyde and 4-divinylaminobenzaldehyde, and their corresponding N-substituted aminothioaldehydes.

The proportion of the compound having at least one structure represented by the formula (1) in its molecule to be incorporated is generally within a range of 0.05 to 300 parts by weight, preferably 0.5 to 200 parts by weight per 100 parts by weight of the colorant. If the proportion of this compound is too low, the dispersibility of the colorant becomes insufficient, and so it is difficult to achieve the expected effect. If the proportion of the compound is too high on the other hand, the dispersing effect of the compound on the colorant is saturated, which is uneconomical. Such a compound is dispersed together with the colorant in the polymer making up the core particles. The compound and colorant are preferably dispersed in the polymer making up the core particles by mixing and dispersing them in the polymerizable monomer for core and subjecting the resultant dispersion to suspension polymerization.

(Colorant)

As examples of the colorant, may be mentioned dyes and pigment such as carbon black, titanium white, Nigrosine Base, aniline blue, Chalcoil Blue, chrome yellow, ultramarine blue, Orient Oil Red, Phthalocyanine Blue and Malachite Green oxalate; and magnetic powders such as cobalt, nickel, diiron trioxide, triiron tetroxide, manganese iron oxide, zinc iron oxide and nickel iron oxide. Besides the above-mentioned colorants, the following various colorants may be mentioned.

Examples of colorants for magnetic color toners include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4 and C.I. Basic Green 6.

Examples of pigments include chrome yellow, cadmium yellow, Mineral Fast Yellow, Navel Yellow, Naphthol Yellow S, Hansa Yellow G, Permanent Yellow NCG, Tartrazine Lake, chrome orange, molybdenum orange, Permanent Orange GTR, Pyrazolone Orange, Benzidine Orange G, cadmium red, Permanent Red 4R, Watchung Red Ca, eosine lake, Brilliant Carmine 3B, manganese violet, Fast Violet B, Methyl Violet Lake, iron blue, cobalt blue, Alkali Blue Lake, Victoria Blue Lake, Phthalocyanine Blue, Fast Sky Blue, Indanthrene Blue BC, chrome green, chromium oxide, Pigment Green B, Malachite Green Lake and Final Yellow Green G.

Examples of magenta color pigments for full-color toners include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207 and 209; C.I. Pigment Violet 19; and C.I. Vat Red 1, 2, 10, 13, 15, 23, 29 and 35.

Examples of magenta dyes include oil-soluble dyes such as C.I. Solvent Red 1, 3, 8, 23, 24, 25, 27, 30, 49, 81, 82, 83, 84, 100, 109 and 121; C.I. Disperse Red 9; C.I. Solvent Violet 8, 13, 14, 21 and 27; and C.I. Disperse Violet 1; and besides basic dyes such as C.I. Basic Red 1, 2, 9, 12, 13, 14, 15, 17, 18, 22, 23, 24, 27, 29, 32, 34, 35, 36, 37, 38, 39 and 40; and C.I. Basic Violet 1, 3, 7, 10, 14, 15, 21, 25, 26, 27 and 28.

Examples of cyan color pigments for full-color toners include C.I. Pigment Blue 2, 3, 15, 16 and 17; C.I. Vat Blue 6; C.I. Acid Blue 45; and copper phthalocyanine pigments with 1 to 5 phthalimidomethyl groups added to a phthalocyanine skeleton.

Examples of yellow color pigments for full-color toners include C.I. Pigment Yellow 1, 2, 3, 4, 5, 6, 7, 10, 11, 12, 13, 14, 15, 16, 17, 23, 65, 73, 83, 138 and 180; and C.I. Vat Yellow 1, 3 and 20.

Among the colorants, the dyes or pigments are used in a proportion of generally 0.1 to 20 parts by weight, preferably 0.5 to 10 parts by weight per 100 parts by weight of the polymerizable monomer for core. The magnetic powder is used in a proportion of generally 1 to 100 parts by weight, preferably 5 to 50 parts by weight per 100 parts by weight of the polymerizable monomer for core.

(Core particles)

The core particles useful in the practice of the present invention generally comprise, as a polymer component, a polymer such as a polyester resin or a (meth)acrylic ester-styrene copolymer and are preferably composed of colored polymer particles comprising the (meth)acrylic ester-styrene copolymer.

In the polymerized toner according to the present invention, the volume average particle diameter (dv) of the core particles is generally 1 to 20 $\mu$m, preferably 1 to 10 $\mu$m. If the volume average particle diameter of the core particles is too great, the resolution of an image formed with such a toner tends to lower. The ratio (dv)/(dp) of the volume average particle diameter (dv) to a number average particle diameter (dp) in the core particles is generally at most 1.7, preferably at most 1.5.

No particular limitation is imposed on the production process of the core particles used in the present invention, and any of emulsion polymerization, suspension polymerization, precipitation polymerization and soap-free polymerization may be used. However, a process comprising subjecting a polymerizable monomer for core to suspension polymerization is preferred in that the colorant can be caused to be uniformly contained in each of core particles formed, and the fixing ability of the resulting toner is improved.

The polymerizable monomer for core used in the present invention is such that can form a polymer having a glass transition temperature of 80° C. or lower, preferably 10 to 70° C., more preferably 20 to 60° C. As the polymerizable monomer for core, there may be used one of such monomers or any combination of such monomers. If the polymerizable monomer for core is a monomer capable of forming a polymer having a glass transition temperature exceeding 80° C., the resulting polymerized toner comes to have a higher fixing temperature and deteriorated permeability through OHP and can not meet the speeding-up of copying or printing.

The glass transition temperature (Tg) of the polymer is a calculated value (referred to as calculated Tg) calculated out according to the kind(s) and proportion(s) of monomer(s) used. When the monomer used is one, the Tg of a homopolymer formed from this monomer is defined as Tg of the polymer in the present invention. For example, the Tg of polystyrene is 100° C. Therefore, when styrene is used as a monomer by itself, the monomer can be said to form a polymer having a Tg of 100° C. When monomers used are two or more, and the polymer formed is a copolymer, the Tg of the copolymer is calculated out according to the kinds and proportions of the monomers used. For example, when 78 wt. % of styrene and 22 wt. % of n-butyl acrylate are used as monomers, the monomers can be said to form a polymer having a Tg of 50° C. because the Tg of a styrene-n-butyl acrylate copolymer formed at this monomer ratio is 50° C.

The definition of "a polymerizable monomer for core, which is capable of forming a polymer having a glass transition temperature of 80° C. or lower" does not mean that when plural monomers are used, the individual monomers must form respective polymers having a Tg of 80° C. or lower. When one monomer is used, the Tg of a homopolymer formed from the monomer must be 80° C. or lower. When two or more monomers are used, however, it is only necessary for the Tg of a copolymer formed from the monomer mixture to be 80° C. or lower. Therefore, those which separately form a homopolymer having a Tg higher than 80° C. may be contained in the monomer mixture. For example, although the Tg of a styrene homopolymer is 100° C., styrene may be used as a component of the polymerizable monomer for core so far as a copolymer having a Tg of 80° C. or lower can be formed by using a mixture of styrene with a monomer (for example, n-butyl acrylate) which forms a homopolymer having a low Tg.

In the present invention, vinyl monomers are generally used as the polymerizable monomer for core. Various kinds of vinyl monomers are used either singly or in combination of two or more thereof so as to adjust the Tg of the resulting polymer within the desired range.

Examples of the vinyl monomers used in the present invention include styrenic monomers such as styrene, vinyltoluene and α-methylstyrene; acrylic acid and methacrylic acid; (meth)acrylic acid derivatives such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone. These vinyl monomers may be used either singly or in any combination thereof.

Of these, a combination of a styrenic monomer with a (meth)acrylic acid derivative is preferably used as the polymerizable monomer for core. As preferable specific examples thereof, may be mentioned combinations of styrene with butyl acrylate (i.e., n-butyl acrylate), and styrene with 2-ethylhexyl acrylate.

It is preferred from the viewpoint of improvement in the shelf stability of the resulting polymerized toner to use a crosslinking monomer together with the vinyl monomer(s). Examples of the crosslinking monomer include aromatic divinyl compounds such as divinylbenzene, divinylnaphthalene and derivatives thereof; diethylenic esters of unsaturated carboxylic acids such as ethylene glycol dimethacrylate and diethylene glycol dimethacrylate; divinyl compounds such as N,N-divinylaniline and divinyl ether; and compounds having at least three vinyl groups. These crosslinking monomers may be used either singly or in any combination thereof. In the present invention, it is desirable that the crosslinking monomer be used in a proportion of generally 0.01 to 5 parts by weight, preferably 0.1 to 2 parts by weight per 100 parts by weight of the polymerizable monomer for core.

In the present invention, it is preferred to use a macromonomer together with the polymerizable monomer for core in that the balance between the low-temperature fixing ability and shelf stability of the resulting polymerized toner is improved. The macromonomer (also referred to as macromer) used in the present invention is a relatively long-chain linear molecule having a polymerizable functional group (for example, a group containing an unsaturated bond such as a carbon-carbon double bond) at its molecular chain terminal. The macromonomer is preferably an oligomer or polymer having a polymerizable vinyl functional group at its molecular chain terminal and a number average molecular weight of generally 1,000 to 30,000. If a macromonomer having a too low number average molecular weight is used, the surface part of the resulting polymerized toner becomes soft, and its shelf stability shows a tendency to deteriorate. If a macromonomer having a too high number average molecular weight is used on the other hand, the melt property of the macromonomer becomes poor, resulting in a polymerized toner deteriorated in fixing ability.

Examples of the polymerizable vinyl functional group which the macromonomer has at its molecular chain terminal include an acryloyl group and a methacryloyl group, with the methacryloyl group being preferred from the viewpoint of easy copolymerization.

The macromonomer used in the present invention preferably has a glass transition temperature higher than that of a polymer obtained by polymerizing the polymerizable monomer for core. A difference in Tg between the polymer obtained by polymerizing the polymerizable monomer for core and the macromonomer may be relative. For example, when the polymerizable monomer for core is such that forms a polymer having a Tg of 70° C., it is only necessary for the macromonomer to have a Tg higher than 70° C. When the polymerizable monomer for core is such that forms a polymer having a Tg of 20° C., the macromonomer may also be that having a Tg of, for example, 60° C. The Tg of the macromonomer is a value measured by means of an ordinary measuring device such as a differential scanning calorimeter (DSC).

As examples of the macromonomer used in the present invention, may be mentioned polymers obtained by polymerizing styrene, styrene derivatives, methacrylic esters, acrylic esters, acrylonitrile and methacrylonitrile either singly or in combination of two or more monomers thereof; macromonomers having a polysiloxane skeleton; and those disclosed in Japanese Patent Application Laid-Open No. 203746/1991, pages 4 to 7. Of these macromonomers, hydrophilic macromonomers, in particular, polymers obtained by polymerizing methacrylic esters or acrylic esters either singly or in combination of two or more monomers thereof are preferred in the present invention.

The amount of the macromonomer used is generally 0.01 to 10 parts by weight, preferably 0.03 to 5 parts by weight, more preferably 0.05 to 1 part by weight per 100 parts by weight of the polymerizable monomer for core. If the amount of the macromonomer used is too little, it is difficult to improve the shelf stability and fixing ability of the resulting polymerized tone in a well balanced relation. If the amount of the macromonomer used is too great, the resulting polymerized toner shows a tendency to deteriorate its fixing ability.

In the present invention, it is preferred that the core particles be provided by subjecting the polymerizable monomer for core as a polymerizable component, and optionally the macromonomer and the crosslinking monomer to suspension polymerization.

The suspension polymerization is generally performed in an aqueous medium containing a dispersion stabilizer. More specifically, the suspension polymerization is conducted by mixing a vinyl monomer, optional macromonomer and crosslinking monomer, a colorant, a compound having at least one bond represented by the formula (1) in its molecule, a radical polymerization initiator, and other additives, uniformly dispersing them by means of a ball mill or the like to prepare a liquid mixture (hereinafter, may be referred to as the stock dispersion), pouring the stock dispersion into an aqueous medium containing a dispersion stabilizer to disperse the stock dispersion in the aqueous medium by means of a mixer having high shearing force, thereby forming minute droplets of the stock dispersion, and then polymerizing them at a temperature of generally 30 to 200° C.

When the radical polymerization initiator is not contained in the stock dispersion, the polymerization initiator may be poured into the aqueous medium containing the dispersion stabilizer with stirring after pouring the stock dispersion into the aqueous medium and before the formation of minute droplets, thereby preparing a polymerizable monomer composition for core.

The time the radical polymerization initiator is added varies according to the intended toner particles, but is generally a point of time the droplet diameter (volume average droplet diameter) of primary droplets formed by the stirring of the stock dispersion has amounted to generally 50 to 1,000 $\mu$m, preferably 100 to 500 $\mu$m. If the time period from the pouring and stirring of the stock dispersion containing no initiator to the addition of the radical polymerization initiator is long, the formation of the minute droplets is completed, so that the monomer and the like in the stock dispersion containing no initiator cannot be uniformly mixed with the oil-soluble polymerization initiator, resulting in the difficulty of making the resin properties of the resulting individual polymerized toner particles, such as polymerization degree and crosslinking degree, even. Therefore, the point of time the radical polymerization initiator is added is generally within 24 hours, preferably 12 hours, more preferably 3 hours after the pouring of the stock dispersion containing no initiator in a large-scale production like plant or the like, and generally within 5 hours, preferably 3 hours, more preferably 1 hour in a small-scale production at a laboratory level though it somewhat varies according to the scale of reaction and droplet diameter.

The temperature of the aqueous dispersion medium between the addition of the radical polymerization initiator and the subsequent formation of minute droplets (i.e., before the initiation of polymerization) is regulated within a range of generally 10 to 40° C., preferably 20 to 30° C. If this temperature is too high, the polymerization reaction is partially initiated within the system. If the temperature is too low on the other hand, the flowability of the system is lowered when the droplets are formed by stirring, so that there is a possibility that such a too low temperature may interfere with the formation of the droplets.

Incidentally, the colorant may also be subjected to a surface treatment with the compound having at least one bond represented by the formula (1) in its molecule in advance and then mixed with the vinyl monomer and the like.

A dispersing agent (dispersion stabilizer) preferably used in the present invention is that containing colloid of a hardly water-soluble metallic compound. As examples of the hardly water-soluble metallic compound, may be mentioned sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and ferric hydroxide. Dispersing agents containing the colloid of a hardly water-soluble metal hydroxide among these are preferred because the particle diameter distribution of the resulting polymer particles can be narrowed, and the brightness or sharpness of an image formed from such a polymerized toner is enhanced. In particular, when the crosslinking monomer is not copolymerized, the dispersing agent containing the colloid of the hardly water-soluble metal hydroxide is preferably used for improving the fixing ability and shelf stability of the resulting polymerized toner.

The dispersion stabilizer containing the colloid of the hardly water-soluble metal hydroxide is not limited by the production process thereof. However, it is preferred to use colloid of a hardly water-soluble metal hydroxide obtained by adjusting the pH of an aqueous solution of a water-soluble polyvalent metallic compound to 7 or higher, in particular, colloid of a hardly water-soluble metal hydroxide formed by reacting a water-soluble polyvalent metallic compound with an alkali metal hydroxide in an aqueous phase.

The colloid of the hardly water-soluble metal hydroxide used in the present invention preferably has number particle diameter distributions, $D_{50}$ (50% cumulative value of number particle diameter distribution) of at most 0.5 $\mu$m and $D_{90}$ (90% cumulative value of number particle diameter distribution) of at most 1 $\mu$m. If the particle diameter of the colloid is too great, the stability of the polymerization is broken, and the shelf stability of the resulting polymerized toner is deteriorated.

The dispersing agent is generally used in a proportion of 0.1 to 20 parts by weight per 100 parts by weight of the polymerizable monomer for core. If the proportion of the dispersing agent used is too low, it is difficult to achieve sufficient polymerization stability, so that the resulting polymer tends to aggregate. If the proportion of the dispersing agent used is too high on the other hand, the viscosity of the aqueous dispersion medium becomes too high, and the particle diameter distribution of the resulting polymerized toner becomes wide. It is hence not preferred to use the dispersing agent in such a too low or high proportion.

In the present invention, a dispersing agent containing a water-soluble polymer may be used as needed. As examples of the water-soluble polymer, may be mentioned polyvinyl alcohol, methyl cellulose and gelatin. In the present invention, there is no need to use any surfactant. However, a surfactant may be used for the purpose of stably conducting the polymerization so far as the dependence of the charge properties of the resulting polymerized toner on environment does not become high.

As examples of the radical polymerization initiator, may be mentioned persulfates such as potassium persulfate and ammonium persulfate; azo compounds such as 4,4'-azobis (4-cyanovaleric acid), 2,2'-azobis-(2-methylpropionate) dimethyl, 2,2'-azobis(2-amidinopropane) bihydrochloride, 2,2'-azobis-2-methyl-N-1,1-bis(hydroxymethyl)-2-hydroxy-ethylpropionamide, 2,2'-azobis(2,4-dimethylvaleronitrile), 2,2'-azobisisobutyronitrile and 1,1'-azobis(1-cyclohexanecarbonitrile); and peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, di-isopropyl peroxydicarbonate and di-t-butyl peroxyisophthalate. Redox initiators composed of combinations of these polymerization initiators with a reducing agent may also be mentioned.

Of these radical polymerization initiators, oil-soluble radical initiators are preferred, with oil-soluble radical initiators selected from among organic peroxides whose ten-hour half-life temperatures are 60 to 80° C., preferably 65 to 80° C. and whose molecular weights are 250 or lower being particularly preferred. Of the oil-soluble radical initiators, t-butyl peroxy-2-ethylhexanoate is particularly preferred because the resulting polymerized toner scarcely gives odor upon printing and barely causes environmental destruction by volatile components such as odor.

The amount of the polymerization initiator used is generally 0.001 to 3 wt. % based on the aqueous medium. If the amount of the polymerization initiator used is less than 0.001 wt. %, the rate of polymerization becomes slow. Any amount exceeding 3 wt. % is not economical.

In the present invention, as needed, various kinds of additives such as a molecular weight modifier and a parting agent may be used by mixing them with the polymerizable monomer for core.

Examples of the molecular weight modifier include mercaptans such as t-dodecylmercaptan, n-dodecylmercaptan and n-octylmercaptan; and halogenated hydrocarbons such as carbon tetrachloride and carbon tetrabromide. These molecular weight modifiers may be added before the initiation of the polymerization or in the course of the polymerization. The molecular weight modifier is used in a proportion of generally 0.01 to 10 parts by weight, preferably 0.1 to 5 parts by weight per 100 parts by weight of the polymerizable monomer for core.

As examples of the parting agent, may be mentioned low molecular weight polyolefins such as low molecular weight polyethylene, low molecular weight polypropylene and low molecular weight polybutylene; paraffin waxes; and polyfunctional ester compounds. As the parting agents used in the present invention, the polyfunctional ester compounds are preferred, with polyfunctional ester compounds formed of a trifunctional or still higher polyfunctional polyhydric alcohol and a carboxylic acid being particularly preferred.

Examples of the trifunctional or still higher polyfunctional polyhydric alcohol include aliphatic alcohols such as glycerol, pentaerythritol and pentaglycerol; alicyclic alcohols such as phloroglucitol, quercitol and inositol; aromatic alcohols such as tris-(hydroxymethyl)benzene; saccharides such as D-erythrose, L-arabinose, D-mannose, D-galactose, D-fructose, L-rhamnose, saccharose, maltose and lactose; and sugar alcohols such as erythoritol, D-threitol, L-arabitol, adonitol and xylitol. Of these, pentaerythritol is preferred.

Examples of the carboxylic acid include aliphatic carboxylic acids such as acetic acid, butyric acid, caproic acid, enanthic acid, caprylic acid, pelargonic acid, capric acid, undecanoic acid, lauric acid, myristic acid, stearic acid, margaric acid, arachidic acid, cerotic acid, melissic acid, erucic acid, brassidic acid, sorbic acid, linolic acid, linolenic acid, behenolic acid, tetrolic acid and ximenynic acid; alicyclic carboxylic acids such as cyclohexanecarboxylic acid, hexahydroisophthalic acid, hexahydroterephthalic acid and 3,4,5,6-tetrahydrophthalic acid; and aromatic carboxylic acids such as benzoic acid, toluic acid, cuminic acid, phthalic acid, isophthalic acid, terephthalic acid, trimesic acid, trimellitic acid and hemimellitic acid. Of these, carboxylic acids having, preferably, 10 to 30 carbon atoms, more preferably, 13 to 25 carbon atoms are preferred, and aliphatic carboxylic acids having the said number of carbon atoms are more preferred. Among the aliphatic carboxylic acids, stearic acid and myristic acid are particularly preferred.

In the polyfunctional ester compound used as a parting agent in the present invention, the carboxylic acids bonded to the trifunctional or still higher polyfunctional polyhydric alcohol may be the same or different from one another. It is preferred that a difference between the maximum value and the minimum value in the number of carbon atoms among plural carboxylic acids bonded be at most 9, preferably at most 5.

As specific examples of the polyfunctional ester compound, may be mentioned pentaerythritol tetrastearate, pentaerythritol tetramyristate and glycerol triarachidate. It is preferred that the polyfunctional ester compound be easily soluble in the polymerizable monomer for core. Among the polyfunctional ester compounds, pentaerythritol tetrastearate and pentaerythritol tetramyristate are preferred, with pentaerythritol tetramyristate being particularly preferred. In the case where a parting agent is mixed with the polymerizable monomer, the conventional waxes must be dispersed in the monomer by grinding or melting them. However, pentaerythritol tetramyristate or the like among the polyfunctional ester compounds is easily soluble in the polymerizable monomer even at ordinary temperature, so that the polymerizable monomer composition can be prepared with ease, and moreover a polymerized toner excellent in various properties can be provided.

The parting agent is used in a proportion of generally 0.1 to 40 parts by weight, preferably 1 to 20 parts by weight per 100 parts by weight of the polymerizable monomer. If the amount of the parting agent used is too little, the effect of improving the low-temperature fixing ability becomes little. If the amount is too great, the blocking resistance of the resulting polymerized toner is deteriorated.

A lubricant such as oleic acid or stearic acid; a dispersion aid such as a silane or titanium coupling agent; and/or the like may also be used with a view toward uniformly dispersing the colorant in the core particles. Such a lubricant or dispersion aid is generally used in a proportion of about 1/1,000 to 1/1 based on the weight of the colorant.

In the polymerization for obtaining the core particles used in the present invention, the conversion of the polymerizable monomer into a polymer is generally controlled to at least 80%, preferably at least 85%, more preferably at least 90%. If the conversion into the polymer is lower than 80%, a great amount of the polymerizable monomer for core remains unreacted, so that each surface of the resultant core particles is covered with a copolymer of a polymerizable monomer for shell and the polymerizable monomer for core even when the polymerizable monomer for shell is added to conduct polymerization. Therefore, a difference in Tg between the core particles and the shell becomes small, and so the resulting polymerized toner tends to lower its shelf stability.

(Formation of shell)

In the present invention, a polymerizable monomer for shell is polymerized in the presence of the core particles to form a polymer layer (shell) on each surface of the core particles.

The polymerizable monomer for shell used in the present invention is such that can form a polymer having a glass transition temperature higher than that of the polymer component making up the core particles. A difference in Tg between the polymer obtained by the polymerizable monomer for shell and the polymer component (usually, the polymer obtained by the polymerizable monomer for core) making up the core particles is relative.

As the polymerizable monomer for shell, there may be generally used monomers capable of forming a polymer having a glass transition temperature higher than 80° C., such as styrene and methyl methacrylate, either singly or in combination of two or more monomers thereof. When the glass transition temperature of the polymer component of the core particles is far lower than 80° C., the polymerizable monomer for shell may be such that forms a polymer having a glass transition temperature of 80° C. or lower. However, the glass transition temperature of the polymer formed from the polymerizable monomer for shell must be preset so as to be higher than the glass transition temperature of the polymer component of the core particles. In order to improve the shelf stability of the resulting polymerized toner, the glass transition temperature of the polymer formed from the polymerizable monomer for shell is preset within a range of generally 50 to 120° C., preferably 60 to 110° C., more preferably 80 to 105° C. If the glass transition temperature of the polymer formed from the polymerizable monomer for shell is extremely too low, the shelf stability of the resulting polymerized toner may be lowered in some cases even if such a glass transition temperature is higher than that of the polymer component of the core particles. In many cases, the glass transition temperature of the polymer component of the core particles may be represented by the calculated Tg of a polymer formed from the polymerizable monomer for core.

A difference in glass transition temperature between the polymer formed from the polymerizable monomer for core and the polymer formed from the polymerizable monomer for shell is generally at least 10° C., preferably at least 20° C., more preferably at least 30° C.

The polymerizable monomer for shell is preferably polymerized in the presence of the core particles after it is formed into droplets smaller than the number average particle diameter of the core particles in an aqueous dispersion medium. If the droplet diameter of the droplets of the polymerizable monomer for shell is too great, the resulting polymerized toner shows a tendency to lower its shelf stability. In order to form the polymerizable monomer for shell into fine droplets, a mixture of the polymerizable monomer for shell and the aqueous dispersion medium is subjected to a finely dispersing treatment by means of, for example, an ultrasonic emulsifier. It is preferred that the aqueous dispersion thus obtained be added to the aqueous dispersion medium in which the core particles are present.

The polymerizable monomer for shell is not particularly limited by solubility in water at 20° C. However, when a polymerizable monomer for shell having a solubility of at least 0.1 wt. % in water at 20° C. is used, the monomer having a high solubility in water at 20° C. becomes liable to quickly migrate to the surfaces of the core particles, so that a polymerized toner having good shelf stability is easy to obtain.

On the other hand, when a polymerizable monomer for shell having a solubility lower than 0.1 wt. % in water at 20° C. is used, its migration to the surfaces of the core particles becomes slow. Therefore, it is preferable to polymerize such a monomer after adding it in the form of fine droplets to the reaction system. Even when a polymerizable monomer for shell having a solubility lower than 0.1 wt. % in water at 20° C. is used, the polymerizable monomer for shell becomes easy to quickly migrate to the surfaces of the core particles when an organic solvent having a solubility of at least 5 wt. % in water at 20° C. is added to the reaction system, so that a polymerized toner having good shelf stability is easy to obtain.

Examples of the polymerizable monomer for shell having a solubility lower than 0.1 wt. % in water at 20° C. include styrene, butyl acrylate, 2-ethylhexyl acrylate, ethylene and propylene. Examples of the polymerizable monomer for shell having a solubility of at least 0.1 wt. % in water at 20° C. include (meth)acrylic esters such as methyl methacrylate and methyl acrylate; amides such as acrylamide and methacrylamide; vinyl cyanide compounds such as acrylonitrile and methacrylonitrile; nitrogen-containing vinyl compounds such as 4-vinylpyridine; and vinyl acetate and acrolein.

As examples of the organic solvent preferably used in the case where the polymerizable monomer for shell having a solubility lower than 0.1 wt. % in water at 20° C. is used, may be mentioned lower alcohols such as methanol, ethanol, isopropyl alcohol, n-propyl alcohol and butyl alcohol; ketones such as acetone and methyl ethyl ketone; cyclic ethers such as tetrahydrofuran and dioxane; ethers such as dimethyl ether and diethyl ether; and aldehydes such as dimethylformaldehyde.

The organic solvent is added in such an amount that the solubility of the polymerizable monomer for shell in the dispersion medium (containing water and the organic solvent in combination) is at least 0.1 wt. %. The amount of the organic solvent used varies according to the kind of the organic solvent, and the kind and amount of the polymerizable monomer for shell. However, it is generally 0.1 to 50 parts by weight, preferably 0.1 to 40 parts by weight, more preferably 0.1 to 30 parts by weight per 100 parts by weight of the aqueous dispersion medium. No particular limitation is imposed on the order of addition of the organic solvent and the polymerizable monomer for shell to the reaction system. In order to facilitate the migration of the polymerizable monomer for shell to the core particles to make easy to obtain a polymerized toner having good shelf stability, however, it is preferable to first add the organic solvent to the reaction system and then add the polymerizable monomer for shell.

When a monomer having a solubility lower than 0.1 wt. % in water at 20° C. and a monomer having a solubility of at least 0.1 wt. % in water at 20° C. are used in combination, it is preferable to first add the monomer having a solubility of at least 0.1 wt. % in water at 20° C. to polymerize it, then add the organic solvent, and further add the monomer having a solubility lower than 0.1 wt. % in water at 20° C. to polymerize it. According to this adding process, the Tg of the polymer obtained from the polymerizable monomer for shell, which is polymerized in the presence of the core particles, and the amount of the monomer added can be suitably controlled for the purpose of controlling the fixing temperature of the resulting polymerized toner.

The polymerizable monomer for shell is preferably used in combination with a charge control agent. The charge control agent is used for improving the charge properties of the resulting polymerized toner. As the charge control agent, there may be used various kinds of charge control agents for positive charge and negative charge. As specific examples of the charge control agents, may be mentioned Nigrosine NO1 (product of Orient Chemical Industries Ltd.), Nigrosine EX (product of Orient Chemical Industries Ltd.), Spiron Black TRH (product of Hodogaya Chemical Co., Ltd.), T-77 (product of Hodogaya Chemical Co., Ltd.), Bontron S-34 (product of Orient Chemical Industries Ltd.) and Bontron E-84 (product of Orient Chemical Industries Ltd.). The charge control agent is used in a proportion of generally 0.01 to 10 parts by weight, preferably 0.1 to 5 parts by weight per 100 parts by weight of the polymerizable monomer for shell.

As examples of a specific process for polymerizing the polymerizable monomer for shell in the presence of the core particles, may be mentioned a process in which the polymerizable monomer for shell is added to the reaction system of the polymerization reaction which has been conducted for obtaining the core particles, thereby continuously conducting polymerization, and a process in which the core particles obtained in a separate reaction system are charged, to which the polymerizable monomer for shell is added, thereby conducting polymerization stepwise. The polymerizable monomer for shell may be added to the reaction system in one lot, or continuously or intermittently by means of a pump such as a plunger pump.

In order to make easy to obtain polymer particles of core-shell structure, it is preferable to add a water-soluble radical initiator at the time the polymerizable monomer for shell is added. It is considered that when the water-soluble radical initiator is added upon the addition of the polymerizable monomer for shell, the water-soluble initiator enters in the vicinity of each outer surface of the core particles to which the polymerizable monomer for shell has migrated, so that a polymer layer (shell) is easy to form on the core particle surface.

As examples of the water-soluble radical initiator, may be mentioned persulfates such as potassium persulfate and ammonium persulfate; azo initiators such as 4,4'-azobis-(4-cyanovaleric acid), 2,2'-azobis(2-amidinopropane), bihydrochloride and 2,2'-azobis-2-methyl-N-1,1'-bis(hydroxymethyl)-2-hydroxyethylpropionamide; and combinations of an oil-soluble initiator such as cumene peroxide with a redox catalyst. The amount of the water-soluble radical initiator used is generally 0.001 to 1 wt. % based on the aqueous medium.

(Polymerized toner)

In the polymerized toner according to the present invention, a weight ratio of the polymerizable monomer for core to the polymerizable monomer for shell is generally 40/60 to 99.9/0.1, preferably 60/40 to 99.5/0.5, more preferably 80/20 to 99/1. If the proportion of the polymerizable monomer for shell is too low, the effect of improving the shelf stability becomes little. If the proportion is too high on the other hand, the effects of lowering the fixing temperature and improving the permeability through OHP become little.

The polymerized toner according to the present invention is composed of fine spherical particles sharp in particle diameter distribution in which the volume average particle diameter is generally 1 to 20 $\mu$m, preferably 3 to 15 $\mu$m, and the particle diameter distribution (volume average particle diameter/number average particle diameter) is generally at most 1.6, preferably at most 1.5.

The polymerized toner according to the present invention is composed of polymer particles of core-shell structure, comprising the core particles and the shell which covers each of the core particles.

In the polymerized toner according to the present invention, the average thickness of the shell is generally 0.001 to 1 $\mu$m, preferably 0.005 to 0.5 $\mu$m. If the thickness of the shell is too great, the fixing ability of the toner is deteriorated. If the thickness is too small on the other hand, the shelf stability of the toner is deteriorated. The particle diameters of the core particles and the thickness of the shell in the polymerized toner can be determined by directly measuring the size and shell thickness of each of particles selected at random from electron photomicrographs thereof when they can be observed through an electron microscope. If the particle diameters of the core particles and the thickness of the shell are difficult to observe through the electron microscope, the particle diameters of the core particles are measured through the electron microscope in the same manner as described above or by means of a Coulter counter at the stage of formation of the core particles. After the core particles are then covered with the shell, the particle diameters of the resultant polymerized toner particles are measured again through the electron microscope or by means of the Coulter counter, whereby the average thickness of the shell can be found from a change in particle diameter before and after the covering with the shell. When it is difficult to measure the shell thickness by these methods, the thickness of the shell can be calculated out from the particle diameter of the core particles and the used amount of the polymerizable monomer for forming the shell.

The polymerized toner according to the present invention contains toluene-insoluble matter in an amount of generally at most 50 wt. %, preferably at most 20 wt. %, more preferably at most 10 wt. %. If the toluene-insoluble matter is contained in plenty, such a polymerized toner shows a tendency to lower its fixing ability. The toluene-insoluble matter is determined by placing a polymer mass obtained by pressing the polymerized toner in a 80-mesh woven metal basket, immersing the basket in toluene for 24 hours at room temperature, and then measuring the dry weight of solids remaining in the basket to express it in terms of % by weight based on the weight of the polymer.

The polymerized toner according to the present invention has a ratio (rl/rs) of the length (rl) to the breadth (rs) within a range of 1 to 1.25, preferably 1 to 1.20, more preferably 1 to 1.15. If the ratio is too high, the resolution of an image formed from such a polymerized toner is deteriorated. In addition, when such a polymerized toner is contained in a toner container in an image forming apparatus, its durability shows a tendency to lower, since friction between particles of the polymerized toner becomes greater, and so external additives are separated from the toner.

(Developer)

The polymerized toner according to the present invention may be used as a developer as it is. However, it is generally combined with external additives such as a flowability improver and an abrasive to provide a developer. When the external additives are added and mixed into the polymerized toner, the additives attach to the surface of the polymerized toner. The external additives bear an action that the flowability of the polymerized toner is enhanced, or that the formation of a toner film on a photosensitive member or the like is prevented by their abrading action.

Typical external additives include inorganic particles and organic resin particles. Examples of the inorganic particles include particles of silica, aluminum oxide, titanium oxide, zinc oxide, tin oxide, barium titanate, strontium titanate, etc. Examples of the organic resin particles include particles of methacrylic ester polymers, acrylic ester polymers, styrene-methacrylic ester copolymers and styrene-acrylic ester copolymers, and core-shell type particles in which the core is composed of a methacrylic ester polymer, and the shell is composed of a styrene polymer.

Of these, the particles of the inorganic oxides are preferred, and the silica particles are more preferred, with silica particles subjected to a hydrophobicity-imparting treatment being particularly preferred. In order to attach the external additives to the polymerized toner, in general, the external additives and the polymerized toner are charged into a mixer such as a Henschel mixer to mix them under stirring. No particular limitation is imposed of the amount of the external additives used. However, it is generally about 0.1 to 6 parts by weight per 100 parts by weight of the polymerized toner.

When the polymerized toner according to the present invention is used, the fixing temperature can be lowered to a low temperature of 80 to 180° C., preferably 100 to 150° C., more preferably 100 to 130° C. In addition, the polymerized toner does not aggregate during its storage and is hence excellent in shelf stability.

(Image forming apparatus)

An image forming apparatus, to which the polymerized toner according to the present invention is applied, comprises a photosensitive member (photosensitive drum), a means for charging the surface of the photosensitive member, a means for forming an electrostatic latent image on the surface of the photosensitive member, a means for receiving a toner (developer), a means for supplying the toner to develop the electrostatic latent image on the surface of the photosensitive member, thereby forming a toner image, and a means for transferring the toner image from the surface of the photosensitive member to a transfer medium. A specific example of such an image forming apparatus is illustrated in FIG. 1.

As illustrated in FIG. 1, in the image forming apparatus, a photosensitive drum 1 as a photosensitive member is installed rotatably in the direction of an arrow A. The photosensitive drum 1 has a structure that a photoconductive layer is provided around a peripheral surface of an electroconductive support drum. The photoconductive layer is composed of, for example, an organic photosensitive member, selenium photosensitive member, zinc oxide photosensitive member or amorphous silicon photosensitive member.

Around the photosensitive drum 1, a charging roll 2 as a charging means, a laser beam irradiating device 3 as a latent image forming means, a developing roll 4 as a developing means, a transfer roll 10 as a transfer means, and optionally a cleaning device (not illustrated) are arranged along the circumferential direction of the drum.

The charging roll 2 serves to uniformly and evenly charge the surface of the photosensitive drum 1 either positively or negatively. Voltage is applied to the charging roll 2, and the charging roll 2 is brought into contact with the surface of the photosensitive drum 1, thereby charging the surface of the photosensitive drum 1. The charging roller 2 may be replaced by a charging means according to corona discharge.

The laser beam irradiating device 3 serves to irradiate the surface of the photosensitive drum 1 with light corresponding to image signals to expose the surface of the photosensitive drum 1 evenly charged to the light on the predetermined pattern, thereby forming an electrostatic latent image on the exposed portion of the drum (in the case of reversal development) or forming an electrostatic latent image on the unexposed portion of the drum (in the case of normal development). An example of other latent image forming means includes that composed of an LED array and an optical system.

The developing roll 4 serves to apply a toner to the electrostatic latent image formed on the photosensitive drum 1. Bias voltage is applied between the developing roll 4 and the photosensitive drum 1 in such a manner that the toner is applied only to a light-exposed portion of the photosensitive drum 1 in reversal development, or only to a light-unexposed portion of the photosensitive drum 1 in normal development.

In a casing 9 for receiving the toner 7, the developing roll 4 and a feed roll 6 are provided. The developing roll 4 is arranged in close vicinity to the photosensitive drum 1 in such a manner that a part thereof comes into contact with the photosensitive drum 1, and is rotated in a direction B opposite to the rotating direction of the photosensitive drum 1. The feed roll 6 is rotated in contact with and in the same direction C as the developing roll 4 to supply the toner 7 to the outer periphery of the developing roll 4. An agitating means (agitating blade) 8 for agitating the toner is installed in the casing 9.

A blade 5 for developing roll as a layer thickness regulating means is arranged at a position between the contact point with the feed roll 6 and the contact point with the photosensitive drum 1 on the periphery of the developing roll 4. The blade 5 is composed of conductive rubber or stainless steel, and voltage of |200 V| to |600 V| is applied to the blade to charge the toner. Therefore, the resistivity of the blade 5 is preferably $10^6$ Ωcm or lower.

The polymerized toner 7 according to the present invention is contained in the casing 9 of the image forming apparatus. The polymerized toner 7 may comprise external additives such as a flowability improver. Since the polymerized toner according to the present invention has a core-shell structure, and the shell of the surface layer is formed of a polymer having a relatively high glass transition temperature, the stickiness of the surface is reduced, and so the polymerized toner is prevented from aggregating during storage in the casing 9. In addition, since the particle diameter distribution of the polymerized toner according to the present invention is relatively sharp, the toner layer formed on the developing roll 4 can be made a substantially single layer by the layer thickness regulating means 5, thereby forming images with good reproducibility.

The transfer roll 10 serves to transfer the toner image formed on the surface of the photosensitive drum 1 by the developing roll 4 to a transfer medium 11. Examples of the transfer medium 11 include paper and resin sheets such as OHP sheets. As transferring means, may be mentioned a corona discharge device and a transfer belt in addition to the transfer roll 10.

The toner image transferred to the transfer medium 11 is fixed to the transfer medium by a fixing means. The fixing means is generally composed of a heating means and a press-bonding means. More specifically, the fixing means is generally composed of the combination of a heating roll (fixing roll) 12 and a press roll 13. The transfer medium 11, to which the toner image has been transferred, is passed through between the heating roll 12 and the press roll 13 to melt the toner, and at the same time press-bond it to the transfer medium 11, thereby fixing the toner image thereto.

In the image forming apparatus. according to the present invention, the polymerized toner according to the present invention is used as a toner. Therefore, the toner is easily melted even when the heating temperature by the heating means is low, and is fixed to the surface of the transfer medium in a flattened state by slightly pressing it by the press-bonding means, so that high-speed printing or copying is feasible. Further, the toner image fixed to an OHP sheet is excellent in permeability through OHP.

The cleaning device serves to clean off the toner remaining on the surface of the photosensitive drum 1 without transferring and is composed of, for example, a cleaning blade or the like. The cleaning device is not always required to install in the case where a system that cleaning is conducted by the developing roll 4 at the same time as development is adopted.

The image forming apparatus illustrated in FIG. 1 comprises, for one photosensitive member, each one of the means for charging the surface of the photosensitive member, the means for forming an electrostatic latent image on the surface of the photosensitive member, the means for receiving the polymerized toner, the means for supplying the polymerized toner to develop the electrostatic latent image on the surface of the photosensitive member, thereby forming a toner image, and the means for transferring the toner image from the surface of the photosensitive member to a transfer medium. However, the image forming apparatus according to the present invention includes a full-color image forming apparatus for forming full-color images, comprising a photosensitive member, and around the photosensitive member, at least four means for respectively forming electrostatic latent images corresponding to magenta, yellow, blue and black on the surface of the photosensitive member, at least four means for respectively receiving the polymerized toners corresponding to magenta, yellow, blue and black, and at least four means for respectively supplying the polymerized toners to develop their corresponding electrostatic latent images on the surface of the photosensitive member, thereby forming a toner image.

(Image forming process)

In the image forming process making use of the polymerized toners according to the present invention, which comprises the steps of applying a toner to the surface of a photosensitive member, on which an electrostatic latent image has been formed, to make the latent image visible, and then transferring the visible image to a transfer medium, the polymerized toner according to the present invention is used as the toner.

EXAMPLES

The present invention will hereinafter be described more specifically by the following Examples and Comparative Examples. Incidentally, all designations of "part" or "parts" and "%" as will be used in the following examples mean part or parts by weight and wt. % unless expressly noted.

Physical properties in the following Examples and Comparative Examples were measured in accordance with the following respective methods.

(1) Particle Diameter of Toner:

The volume average particle diameter (dv) and particle diameter distribution, i.e., a ratio (dv/dp) of the volume average particle diameter to a number average particle diameter (dp) of a polymerized toner sample were measured by means of a Multisizer (manufactured by Coulter Co.). The measurement by the Multisizer was conducted under the following conditions:

aperture diameter: 50 μm;

medium: Isothone II, concentration: 10%; and number of particles measured: 50,000 particles.

(2) Thickness of Shell:

In the examples of the present invention, the thickness of shell in each toner sample was calculated out in the following equation, since the thickness of the shell was thin though it can be measured by the Multisizer or through an electron microscope where the thickness of the shell is great.

$$\pi(r+x)^3/\pi r^3=1+s/100\rho \quad \text{(i)}$$

wherein r: the radius of core particles before addition of a polymerizable monomer for shell (a half of the volume average particle diameter of the core particles found from measurement by the Multisizer; μm);

x: the thickness (μm) of shell;

s: the number of parts of the polymerizable monomer for shell added (the number of parts per 100 parts by weight of a polymerizable monomer for core); and ρ: the density (g/cm$^3$) of a polymer forming the shell.

The equation (i) is transformed into the equation (ii):

$$(x+r)/r=(1+s/100\rho)^{1/3} \quad \text{(ii)}$$

When ρ=1 is substituted into the equation (ii), the equation (iii) is obtained.

$$(x+r)/r=(1+s/100)^{1/3} \quad \text{(iii)}$$

From the equation (iii), the equation (iv) is derived.

$$x=r(1+s/100)^{1/3}-r \quad \text{(iv)}$$

The thickness of the shell was calculated out using the equation (iv).

(3) Volume Resistivity of Toner:

The volume resistivity of each toner sample was measured by means of a dielectric loss measuring device (TRS-10 Model, trade name; manufactured by Ando Electric Co., Ltd.) under conditions of a temperature of 30° C. and a frequency of 1 kHz.

(4) Fixing Temperature of Toner:

A commercially available printer of a non-magnetic one-component development system was modified in such a manner that the temperature of a fixing roll can be varied. This modified printer was used to evaluate a toner sample as to the image. A temperature at which a fixing rate of the toner amounted to 80% was defined as a fixing temperature. The fixing test was conducted by varying the temperature of the fixing roll in the printer to determine the fixing rate at each temperature, thereby finding a relationship between the temperature and the fixing rate. The fixing rate was calculated from the ratio of image densities before and after a peeling operation using a pressure-sensitive adhesive tape, which was conducted against a black solid-printed area of a test paper sheet, on which printing had been made by the modified printer. More specifically, assuming that the image density before the peeling of the adhesive tape is $ID_{before}$, and the image density after the peeling of the adhesive tape is $ID_{after}$, the fixing rate is determined by the following equation:

$$\text{Fixing rate } (\%)=(ID_{after}/ID_{before})\times 100$$

The peeling operation of the pressure-sensitive adhesive tape is a series of operation that a pressure-sensitive adhesive tape (Scotch Mending Tape 810-3-18, product of Sumitomo 3M Limited) is applied to a measuring area of the test paper sheet to cause the tape to adhere to the sheet by pressing the tape under a fixed pressure, and the adhesive tape is then peeled at a fixed rate in a direction along the paper sheet. The image density was measured by means of a reflection image densitometer manufactured by McBeth Co.

(5) Shelf Stability of Toner:

The evaluation of shelf stability was conducted by placing each toner sample in a closed container to seal it, sinking the container into a constant-temperature water bath controlled to 55° C. and then taking the container out of the water bath after a predetermined period of time went on, thereby measuring the weight of toner aggregated. The sample toner taken out of the container was transferred to a 42-mesh screen so as not to destroy the structure thereof as much as possible, and the screen was vibrated for 30 seconds by means of a powder measuring device, REOSTAT (manufactured by Hosokawa Micron Corporation) with the intensity of vibration preset to 4.5. Thereafter, the weight of the toner remaining on the screen was measured to regard it as the weight of the toner aggregated. The aggregation rate (wt. %) of the toner was calculated out from this weight of the aggregated toner and the weight of the sample. The shelf stability of the toner sample was evaluated by 4 ranks in accordance with the following standard:

⊚: aggregation rate was lower than 5 wt. %;

○: aggregation rate was not lower than 5 wt. %, but low than 10 wt. %;

Δ: aggregation rate was not lower than 10 wt. %, but low than 50 wt. %; and

X: aggregation rate was not lower than 50 wt. %.

(6) Permeability through OHP:

The temperature of the fixing roll in the modified printer described above was preset to 170° C. to conduct printing with each toner sample on a commercially available OHP sheet (Transparency, product of Uchida Yoko Co., Ltd.), thereby evaluating the toner sample as to permeability through OHP. The printed OHP sheet was set in an OHP to visually observe whether the color of the printed image was projected or not, thereby ranking it in accordance with the following standard:

○: Good in permeability;

Δ: Insufficient in permeability; and

X: The image did not permeate.

(7) Charge Level of Toner:

The charge level of each toner sample was measured under respective environments of L/L (10° C. in temperature and 20% in humidity) and H/H (35° C. in temperature and 80% in humidity) to evaluate the toner sample as to charge level under varied environments.

The charge level of the toner was determined in the following manner. The toner was charged into a commercially available printer (4 papers per minute printer) under each of the above-described environments and left to stand for 24 hours. Thereafter, a print pattern of half tone was printed 5 times, and the toner on a developing roll was then sucked in a suction type charge level meter to measure a charge level per unit weight from the charge level and weight of the toner sucked at this time.

(8) Evaluation of Image:

Printing was continuously conducted with each toner sample from the beginning to count the number of printed sheets that continuously retained an image density of 1.3 or higher as measured by a reflection densitometer (manufactured by McBeth Co) and at an unprinted area, fog of 10% or lower as measured by a whiteness meter (manufactured by Nippon Denshoku K.K.), thereby evaluating the toner sample as to image in accordance with the following standard:

○: the number of the printed sheets that continuously retained the above-described image quality was 10,000 or more;

Δ: the number of the printed sheets that continuously retained the above-described image quality was not less than 5,000, but less than 10,000; and X: the number of the printed sheets that continuously retained the above-described image quality was less than 5,000.

Referential Example 1

In 500 parts of benzene, were dissolved 100 parts of an unsaturated polyester (softening point: 120° C., acid value:

8), and the resultant solution was charged into a vessel equipped with a stirrer, an internal heater, a condenser and a liquid-solid feed opening, and heated to 60° C. with stirring. Each 0.1 mol of benzylidenestearylamine, benzoyl chloride and tin tetrachloride were then added from the feed opening to conduct a reaction for about 1 hour. After completion of the reaction, the reaction mixture was poured into 1,000 $cm^3$ of methanol to solidify a reaction product. The thus-obtained solidified product was left to stand in a vacuum drier to dry it, thereby obtaining a compound (S1/S2=2.2) having a bond represented by the formula (1). The amount of the bond represented by the formula (1) to be present was determined by a ratio of the intensity (S1) of ultraviolet absorption at 315 nm to intensity (S2) by a refractometer, measured by gel permeation chromatography (GPC).

Referential Example 2

A compound (S1/S2=2.9) having a bond represented by the formula (1) was obtained in the same manner as in Referential Example 1 except that the unsaturated polyester used in Referential Example 1 was changed to a styrene-butadiene block copolymer (styrene/butadiene=90/10, weight average molecular weight: 20,000), and benzylidenestearylamine, benzoyl chloride and tin tetrachloride were changed to benzylidenebutylamine, acetyl chloride and titanium tetrachloride, respectively.

Referential Example 3

A compound (S1/S2=3.0) having a bond represented by the formula (1) was obtained in the same manner as in Referential Example 1 except that the unsaturated polyester used in Referential Example 1 was changed to a styrene-butadiene random copolymer (styrene/butadiene=90/10, weight average molecular weight: 50,000).

Example 1

A monomer mixture (calculated Tg of the resulting copolymer=50° C.) composed of 78 parts of styrene and 22 parts of n-butyl acrylate, 7 parts of carbon black (Printex 150T, trade name; product of Degussa AG), 2 parts of the compound obtained in Referential Example 1, 1 part of a charge control agent (Spiron Black TRH, trade name; product of Hodogaya Chemical Co., Ltd.), 0.3 parts of divinylbenzene, 0.5 parts of a polymethacrylic ester macromonomer (AA6; Tg=94° C.; product of Toagosei Chemical Industry Co., Ltd.), and 10 parts of pentaerythritol tetrastearate were dispersed in a ball mill at room temperature to obtain a stock dispersion.

On one hand, 10 parts of methyl methacrylate (calculated Tg of the resulting polymer=105° C.), 100 parts of water and 0.01 parts of a charge control agent (Bontron E-84, product of Orient Chemical Industries Ltd.) were subjected to a finely dispersing treatment by an ultrasonic emulsifier, thereby obtaining an aqueous dispersion of a polymerizable monomer for shell. The droplet diameter of droplets of the polymerizable monomer for shell was found to be 1.6 $\mu$m in terms of $D_{90}$ as determined by means of a microtrack particle diameter distribution measuring device by adding the droplets at a concentration of 3% to a 1% aqueous solution of sodium hexametaphosphate.

On the other hand, an aqueous solution with 6.9 parts of sodium hydroxide (alkali metal hydroxide) dissolved in 50 parts of ion-exchanged water was gradually added to an aqueous solution with 9.8 parts of magnesium chloride (water-soluble polyvalent metallic salt) dissolved in 250 parts of ion-exchanged water under stirring to prepare a dispersion of colloid of magnesium hydroxide (colloid of hardly water-soluble metal hydroxide). The particle diameter distribution of the colloid formed was measured by means of the microtrack particle diameter distribution measuring device (manufactured by Nikkiso Co., Ltd.) and found to be 0.38 $\mu$m in terms of $D_{50}$ (50% cumulative value of number particle diameter distribution) and 0.82 $\mu$m in terms of $D_{90}$ (90% cumulative value of number particle diameter distribution). The measurement by means of the microtrack particle diameter distribution measuring device was performed under the following conditions:

measuring range: 0.12 to 704 $\mu$m;

measuring time: 30 seconds; and medium: ion-exchanged water.

The stock dispersion prepared above was poured into the colloidal dispersion of magnesium hydroxide obtained above, and 4 parts of t-butyl peroxy-2-ethylhexanoate were added with stirring to prepare a polymerizable monomer composition for core. The resultant monomer composition was stirred at 12,000 rpm under high shearing force by means of a TK type homomixer to form droplets of the polymerizable monomer composition for core. The thus-prepared aqueous dispersion containing droplets of the polymerizable monomer composition for core was charged into a reactor equipped with an agitating blade to initiate a polymerization reaction at 90° C. At the time a conversion into a polymer reached 98%, the polymerizable monomer for shell prepared above and 1 part of a 1% aqueous solution of potassium persulfate were added to continue the reaction for 3 hours. Thereafter, the reaction was stopped to obtain an aqueous dispersion containing polymer particles of core-shell structure.

The volume average particle diameter (dv) of core particles as measured by taking out them just before the addition of the polymerizable monomer for shell was 6.2 $\mu$m, and a ratio of the volume average particle diameter (dv) to the number average particle diameter (dp) thereof was 1.24. The resultant polymer particles had a shell thickness of 0.31 $\mu$m as calculated out from the used amount of the polymerizable monomer for shell and the particle diameter of the core particle, and an rl/rs ratio of 1.1 and contained 3% of toluene-insoluble matter.

While stirring the above-obtained aqueous dispersion of the polymer particles of core-shell structure, the pH of the system was adjusted to not higher than 4 with sulfuric acid to conduct acid washing (25° C., 10 minutes). After water was separated by filtration from the dispersion, 500 parts of ion-exchanged water were newly added to form a slurry again, and the slurry was washed with water. Thereafter, the dehydration and water washing were repeated several times, and solids were then collected by filtration. The thus-collected solids were dried at 45° C. for 2 days by a dryer to obtain polymer particles (polymerized toner).

To 100 parts of the polymerized toner obtained above were added 0.3 parts of colloidal silica (R-202, trade name; product of Nippon Aerosil Co., Ltd.) subjected to a hydrophobicity-imparting treatment, and they were mixed by means of a Henschel mixer to prepare a developer (hereinafter referred to as "toner" merely). The volume resistivity of the toner thus obtained was measured and found to be 11.3 (log$\Omega$·cm).

The toner thus obtained was used to measure its fixing temperature. As a result, it was 120° C. The shelf stability of the toner was extremely good (rank=◎). The results are shown in Table 1. Besides, the evaluation of image revealed that an image high in image density, free of fog and irregularities, and extremely good in resolution was obtained (rank=○).

Example 2

A polymerized toner was obtained in the same manner as in Example 1 except that the compound obtained in Referential Example 1 used in Example 1 was changed to the compound obtained in Referential Example 2. The results are shown in Table 1.

Comparative Example 1

A polymerized toner was obtained in the same manner as in Example 1 except that the styrene-butadiene block copolymer (ST/BD=9/1; Mw=20,000) used in Referential Example 2 was used in place of the compound obtained in Referential Example 1 used in Example 1. The results are shown in Table 1.

Comparative Example 2

A polymerized toner was obtained in the same manner as in Example 1 except that the unsaturated polyester (softening point: 120° C., acid value: 8) used in Referential Example 2 was used in place of the compound obtained in Referential Example 1 used in Example 1. The results are shown in Table 1.

Example 3

A polymerized toner was obtained in the same manner as in Example 1 except that 10 parts of methyl methacrylate used in the polymerizable monomer composition for shell in Example 1 were changed to 9 parts of methyl methacrylate and 1 part of butyl acrylate, and the compound obtained in Referential Example 1 was changed to the compound obtained in Referential Example 3. The results are shown in Table 1.

TABLE 1

| | Example | | | Comp. Ex. | |
|---|---|---|---|---|---|
| | 1 | 2 | 3 | 1 | 2 |
| Core particles: | | | | | |
| dv [μm] | 6.2 | 6.5 | 6.4 | 8.3 | 7.8 |
| dv/dp | 1.24 | 1.27 | 1.25 | 1.52 | 1.62 |
| Polymer particles: | | | | | |
| Thickness of shell [μm] | 0.31 | 0.32 | 0.32 | 0.41 | 0.39 |
| Toluene-insoluble matter [%] | 3 | 4 | 3 | 4 | 7 |
| Evaluation of toner: | | | | | |
| dv [μm] | 6.8 | 7.1 | 7.0 | 9.1 | 8.6 |
| dv/dp | 1.26 | 1.30 | 1.28 | 1.57 | 1.68 |
| Volume resistivity [logΩcm] | 11.3 | 11.4 | 11.4 | 10.8 | 10.6 |
| Fixing temperature [° C.] | 120 | 130 | 120 | 140 | 140 |
| Shelf stability | ⊙ | ⊙ | ⊙ | Δ | Δ |
| Charge level under L/L [μc/g] | −31 | −30 | −29 | −19 | −16 |
| Charge level under H/H [μc/g] | −30 | −29 | −28 | −11 | −9 |
| Evaluation of image | ○ | ○ | ○ | × | × |

As apparent from the result shown in Table 1, when the polymerized toners (Examples 1 to 3) according to the present invention are used, the fixing temperature thereof can be lowered to 120 to 130° C. In addition, the polymerized toners are excellent in shelf stability, low in the dependence of charge level on environment, and hard to cause fogging, lowering of image density, etc. On the other hand, the polymerized toners according to Comparative Examples 1 and 2 are insufficient in the balance between the effect of lowering the fixing temperature and the shelf stability, high in the dependence of charge level on environment, and also low in the evaluation of image.

Example 4

A polymerized toner was obtained in the same manner as in Example 1 except that styrene was used in place of methyl methacrylate making up the polymerizable monomer composition for shell in Example 1, and 20 parts of methanol were added to the reaction system right before the addition of the polymerizable monomer composition for shell. The results are shown in Table 2.

Example 5

A polymerized toner was obtained in the same manner as in Example 1 except that 2,2-azobisisobutyronitrile was used in place of t-butyl peroxy-2-ethylhexanoate used as the polymerization initiator for the polymerizable monomer for core in Example 1, and the reaction temperature was changed to 75° C. The results are shown in Table 2. When a developer (toner) containing this polymerized toner was used to conduct fixing, slight odor was given off.

Example 6

A polymerized toner was obtained in the same manner as in Example 1 except that the compound obtained in Referential Example 1 used in Example 1 was changed to the compound obtained in Referential Example 3. The results are shown in Table 2.

Example 7

A polymerized toner was obtained in the same manner as in Example 1 except that butyl acrylate used in the polymerizable monomer composition for core in Example 1 was changed to 2-ethylhexyl acrylate. The results are shown in Table 2.

TABLE 2

| | Example | | | |
|---|---|---|---|---|
| | 4 | 5 | 6 | 7 |
| Core particles: | | | | |
| dv [μm] | 6.4 | 6.5 | 6.4 | 6.5 |
| dv/dp | 1.21 | 1.28 | 1.21 | 1.25 |
| Polymer particles: | | | | |
| Thickness of shell [μm] | 0.32 | 0.32 | 0.32 | 0.32 |
| Toluene-insoluble matter [%] | 3 | 4 | 4 | 5 |
| Evaluation of toner: | | | | |
| dv [μm] | 7.0 | 7.1 | 7.0 | 7.1 |
| dv/dp | 1.24 | 1.30 | 1.23 | 1.26 |
| Volume resistivity [logΩcm] | 11.3 | 11.4 | 11.4 | 11.5 |
| Fixing temperature [° C.] | 120 | 130 | 120 | 130 |
| Shelf stability | ⊙ | ⊙ | ⊙ | ⊙ |
| Charge level under L/L [μc/g] | −29 | −29 | −30 | −28 |
| Charge level under H/H [μc/g] | −28 | −28 | −29 | −27 |
| Evaluation of image | ○ | ○ | ○ | ○ |

As apparent from the result shown in Table 2, when the polymerized toners (Examples 4 to 7) according to the present invention are used, the fixing temperature thereof can be lowered to 120 to 130° C. In addition, the polymerized toners are excellent in shelf stability, low in the dependence of charge level on environment, and hard to cause fogging, lowering of image density, etc.

Example 8

A polymerized toner was obtained in the same manner as in Example 1 except that 5 parts of a magenta pigment (Pigment Red 122) were used in place of 7 parts of carbon black used in Example 1. The results are shown in Table 3.

Example 9

A polymerized toner was obtained in the same manner as in Example 1 except that 5 parts of a yellow quinophthalone pigment (Pigment Yellow 138) were used in place of 7 parts of carbon black used in Example 1. The results are shown in Table 3.

Example 10

A polymerized toner was obtained in the same manner as in Example 1 except that 5 parts of a cyan pigment (Pigment Blue 15:3) were used in place of 7 parts of carbon black used in Example 1. The results are shown in Table 3.

Comparative Example 3

A polymerized toner was obtained in the same manner as in Comparative Example 1 except that 5 parts of a magenta pigment (Pigment Red 122) were used in place of 7 parts of carbon black used in Comparative Example 1. The results are shown in Table 3.

TABLE 3

| | Example | | | Comp. Ex. |
|---|---|---|---|---|
| | 8 | 9 | 10 | 3 |
| Core particles: | | | | |
| dv [μm] | 6.3 | 6.6 | 6.8 | 8.8 |
| dv/dp | 1.23 | 1.17 | 1.26 | 1.68 |
| Polymer particles: | | | | |
| Thickness of shell [μm] | 0.31 | 0.33 | 0.34 | 0.43 |
| Toluene-insoluble matter [%] | 5 | 4 | 5 | 4 |
| Evaluation of toner: | | | | |
| dv [μm] | 6.9 | 7.3 | 7.5 | 9.7 |
| dv/dp | 1.25 | 1.20 | 1.28 | 1.70 |
| Volume resistivity [logΩcm] | 11.8 | 11.9 | 11.6 | 10.7 |
| Fixing temperature [° C.] | 120 | 130 | 120 | 140 |
| Shelf stability | ◎ | ◎ | ◎ | Δ |
| Charge level under L/L [μc/g] | −31 | −30 | −29 | −16 |
| Charge level under H/H [μc/g] | −30 | −29 | −28 | −8 |
| Permeability through OHP | ○ | ○ | ○ | Δ |
| Evaluation of image | ○ | ○ | ○ | × |

As apparent from the result shown in Table 3, when the polymerized toners (Examples 8 to 10) according to the present invention are used, the fixing temperature thereof can be lowered to 120 to 130° C. In addition, the polymerized toners are excellent in shelf stability, low in the dependence of charge level on environment, and hard to cause fogging, lowering of image density, etc. Further, the polymerized toners according to the present invention is excellent in permeability through OHP. On the other hand, the polymerized toner according to Comparative Example 3 is insufficient in the balance between the effect of lowering the fixing temperature and the shelf stability, high in the dependence of charge level on environment, and also low in the evaluation of image.

INDUSTRIAL APPLICABILITY

According to the present invention, there are provided polymerized toners which have a low fixing temperature and uniformly melting ability, and moreover are excellent in shelf stability, and a production process thereof. The use of the polymerized toners according to the present invention permits the speeding-up of copying or printing, the formation of full-color images and energy saving. The polymerized toners according to the present invention can form toner images which exhibit excellent permeability when conducting printing on an OHP sheet with such a polymerized toner and fixing the resulting image thereto. The polymerized toners according to the present invention permit the formation of high-quality images without causing fogging and lowering of image density. According to the present invention, there are provided an image forming process comprising using the polymerized toner(s) having such excellent various properties, and an image forming apparatus in which the polymerized toner(s) are received.

What is claimed is:

1. A polymerized toner of core-shell structure, comprising core particles composed of colored polymer particles which contain a compound having at least one $>C{=}N^{+}<$ structure in its molecule and a colorant, and a layer of a polymer having a glass transition temperature higher than that of a polymer component making up the core particles, said polymer layer covering each of the core particles.

2. The polymerized toner according to claim 1, wherein the compound having at least one $>C{=}N^{+}<$ structure in its molecule is a heterocycle-containing compound.

3. The polymerized toner according to claim 2, wherein the heterocycle-containing compound is (i) a compound having the structure of a 1,3-oxazine ring or 4H,5H-1,3-oxazine ring, in which the nitrogen atom in the oxazine ring has been converted into a quaternary ammonium salt, (ii) a compound having a 1,3-thiazine ring or 5H,6H-1,3-thiazine ring, in which the nitrogen atom in the thiazine ring has been converted into a quaternary ammonium salt, (iii) a compound having an isoxazole ring or 4H,5H-isoxazole ring, in which the nitrogen atom in the isoxazole ring has been converted into a quaternary ammonium salt, (iv) a compound having a 1,2-diazole ring or 4H,5H-1,3-1,2-diazole ring, in which the nitrogen atom in the diazole ring has been converted into a quaternary ammonium salt, or (v) a compound having a 2H-pyrrole ring or 2H,3H,4H-pyrrole ring, in which the nitrogen atom in the pyrrole ring has been converted into a quaternary ammonium salt.

4. The polymerized toner according to claim 1, wherein the compound having at least one $>C{=}N^{+}<$ structure in its molecule is a modified polymers obtained by reacting an organic compound having a —C(=Y)—N< bond, in which Y is an oxygen atom or sulfur atom, with a living anionic polymer obtained by polymerizing a monomer using an alkali metal or alkaline earth metal, and having an ion of such a metal at its terminal, or a metal-added polymer obtained by reacting an unsaturated polymer having double bonds in its polymer chain or side chain with an alkali metal or alkaline earth metal, and then hydrolyzing the reaction product; or a hydrogenated modified polymer obtained by hydrogenating double bonds in the modified polymer thus obtained.

5. The polymerized toner according to claim 1, wherein the core particles contains the compound having at least one $>C{=}N^{+}<$ structure in its molecule in a proportion of 0.05 to 300 parts by weight per 100 parts by weight of the colorant.

6. The polymerized toner according to claim 1, wherein the core particles are colored polymer particles obtained by subjecting a polymerizable monomer composition containing the compound having at least one $>C{=}N^{+}<$ structure in its molecule, the colorant and a polymerizable monomer for core to suspension polymerization.

7. The polymerized toner according to claim 6, wherein the polymerizable monomer composition further comprises a macromonomer.

8. The polymerized toner according to claim 6, wherein the polymerizable monomer composition further comprises a crosslinking monomer.

9. The polymerized toner according to claim 1, wherein the shell is a polymer layer formed by subjecting a polymerizable monomer for shell to suspension polymerization in the presence of the core particles.

10. The polymerized toner according to claim 1, wherein the core particles further contain a parting agent.

11. The polymerized toner according to claim 1, wherein the core particles having a volume average particle diameter (dv) of 1 to 20 $\mu$m and a ratio of the volume average particle diameter (dv) to a number average particle diameter (dp) of at most 1.7 are covered with the shell composed of the polymer layer having an average thickness of 0.001 to 1.0 $\mu$m.

12. A process for producing a polymerized toner of core-shell structure, which comprises the steps of (I) polymerizing a polymerizable monomer composition containing a compound having at least one $>C{=}N^{+}<$ structure in its molecule, a colorant and a polymerizable monomer for core to prepare core particles formed of colored polymer particles; and then (II) polymerizing a polymerizable monomer for shell, which is capable of forming a polymer having a glass transition temperature higher than that of a polymer component making up the core particles, in the presence of the core particles in an aqueous dispersion medium to form shell which is formed of a polymer layer and covers each of the core particles.

13. The production process according to claim 12, wherein in the steps (I) and (II), the suspension polymerization is conducted in an aqueous dispersion medium containing a dispersing agent.

14. The production process according to claim 13, wherein colloid of a hardly water-soluble metal hydroxide is used as the dispersing agent.

15. The production process according to claim 14, wherein the colloid of the hardly water-soluble metal hydroxide is such that the 50% cumulative value ($D_{50}$) of number particle diameter distribution thereof is at most 0.5 $\mu$m, and the 90% cumulative value ($D_{90}$) of number particle diameter distribution thereof is at most 1 $\mu$m.

16. The production process according to claim 14, wherein the colloid of the hardly water-soluble metal hydroxide is obtained by adjusting the pH of an aqueous solution of a water-soluble polyvalent metallic compound to 7 or higher.

17. The production process according to claim 12, wherein the polymerizable monomer for core comprises a styrenic monomer and a (meth)acrylic acid derivative.

18. The production process according to claim 12, wherein in the step (I), the polymerizable monomer composition further comprises a macromonomer.

19. The production process according to claim 18, wherein the macromonomer is contained in an amount of 0.01 to 10 parts by weight per 100 parts by weight of the polymerizable monomer for core.

20. The production process according to claim 12, wherein in the step (I), the polymerizable monomer composition further comprises a crosslinking monomer.

21. The production process according to claim 12, wherein in the step (I), the polymerizable monomer composition further comprises a parting agent.

22. The production process according to claim 12, wherein in the step (I), the polymerizable monomer composition contains the compound having at least one $>C{=}N^{+}<$ structure in its molecule in a proportion of 0.05 to 300 parts by weight per 100 parts by weight of the colorant.

23. The production process according to claim 13, wherein in the step (I), the polymerizable monomer composition is poured into the aqueous dispersion medium containing the dispersing agent to form minute droplets of the polymerizable monomer composition under stirring, and the suspension polymerization is then conducted in the presence of an oil-soluble radical polymerization initiator at a temperature of 30 to 200° C., thereby preparing core particles composed of colored polymer particles.

24. The production process according to claim 23, wherein in the step (I), core particles composed of colored polymer particles having a volume average particle diameter (dv) of 1 to 20 $\mu$m and a ratio of the volume average particle diameter (dv) to a number average particle diameter (dp) of at most 1.7 are prepared.

25. The production process according to claim 13, wherein in the step (II), the polymerizable monomer for shell is prepared into droplets having a number average droplet diameter smaller than the core particles and then subjected to the suspension polymerization.

26. The production process according to claim 13, wherein in the step (II), a polymerizable monomer for shell having a solubility lower than 0.1 wt. % in water at 20° C. and an organic solvent having a solubility of at least 5 wt. % in water at 20° C. are added to conduct the suspension polymerization.

27. The production process according to claim 13, wherein in the step (II), the polymerizable monomer for shell and a charge control agent are added to conduct the suspension polymerization.

28. The production process according to claim 13, wherein in the step (II), the polymerizable monomer for shell is subjected to the suspension polymerization using a water-soluble radical polymerization initiator.

29. The production process according to claim 12, wherein in the step (II), shell formed of a polymer layer having an average film thickness of 0.001 to 1.0 $\mu$m is formed.

30. An image forming process, comprising the steps of applying a toner to the surface of a photosensitive member, on which an electrostatic latent image has been formed, to make the latent image visible, and then transferring the visible image to a transfer medium, wherein a polymerized toner of core-shell structure, comprising core particles composed of colored polymer particles which contain a compound having at least one $>C{=}N^{+}<$ structure in its molecule and a colorant, and a layer of a polymer having a glass transition temperature higher than that of a polymer component making up the core particles, said polymer layer covering each of the core particles, is used as the toner.

31. An image forming apparatus, comprising a photosensitive member, a means for charging the surface of the photosensitive member, a means for forming an electrostatic latent image on the surface of the photosensitive member, a means for receiving a toner, a means for supplying the toner to develop the electrostatic latent image on the surface of the photosensitive member, thereby forming a toner image, and a means for transferring the toner image from the surface of the photosensitive member to a transfer medium, wherein the means for receiving the toner contains a polymerized toner of core-shell structure, comprising core particles composed of colored polymer particles which contain a compound having at least one $>C{=}N^{+}<$ structure in its molecule and a colorant, and a layer of a polymer having a glass transition temperature higher than that of a polymer component making up the core particles, said polymer layer covering each of the core particles.

* * * * *

UNITED STATES PATENT AND TRADEMARK OFFICE

CERTIFICATE OF CORRECTION

PATENT NO. : 6,200,718 B1
DATED : March 13, 2001
INVENTOR(S) : Takasaki et al.

It is certified that error appears in the above-identified patent and that said Letters Patent is hereby corrected as shown below:

Title page,
Item [87], change the PCT Pub. Date, "November 6, 1998" to be -- June 11, 1998 --.

Signed and Sealed this

Twenty-ninth Day of January, 2002

*Attest:*

*Attesting Officer*

JAMES E. ROGAN
*Director of the United States Patent and Trademark Office*